US005187895A

United States Patent [19]

Huber

[11] Patent Number: 5,187,895

[45] Date of Patent: Feb. 23, 1993

[54] REVOLVING DOOR, PARTICULARLY FOR THE PROTECTION OF THE ACCESS TO A ROOM

[75] Inventor: Jacob R. A. Huber, Edam, Netherlands

[73] Assignee: Boon Edam B.V., Edam, Netherlands

[21] Appl. No.: 810,657

[22] Filed: Dec. 19, 1991

[30] Foreign Application Priority Data

Dec. 21, 1990 [NL] Netherlands ..... 9002849

[51] Int. Cl.[5] ..... E05D 15/02

[52] U.S. Cl. ..... 49/42; 49/28; 49/31

[58] Field of Search ..... 49/42, 43, 44, 28, 31, 49/35; 109/8

[56] References Cited

U.S. PATENT DOCUMENTS 4,530,183 7/1985 Heise et al. ..... 49/42
4,614,057 9/1986 Sorber ..... 49/28 X
4,627,193 12/1986 Schwarz ..... 49/42

FOREIGN PATENT DOCUMENTS

0259522A1 9/1986 European Pat. Off. .
2803765A1 2/1979 Fed. Rep. of Germany .
2590313A1 11/1985 France .

*Primary Examiner*—Philip C. Kannan
*Attorney, Agent, or Firm*—Pennie & Edmonds

[57] ABSTRACT

A revolving door, particularly for the protection of the access to a room, comprises a rotating shaft, a number of door wings spaced around it and mounted thereto and a pair of opposite panels bordering the door wings and defining a partly closed zone with a first and a second opening. Further a drive motor for the shaft and a control unit for the drive motor are provided. The revolving door is provided with a detection means for detecting a person authorized or unauthorized to access the room, and a first sensor for detecting an unauthorized person entering the zone through the first or the second opening respectively. The control unit turns off the drive motor in response to the first sensor. A second sensor is adapted to detect the presence of an unauthorized person outside said zone in or close to the first or second opening respectively, wherein the control unit turns off the drive motor in response to said second sensor.

1 Claim, 2 Drawing Sheets

REVOLVING DOOR, PARTICULARLY FOR THE PROTECTION OF THE ACCESS TO A ROOM

BACKGROUND OF THE INVENTION

The invention relates to a revolving door, particularly for the protection of the access to a room, comprising a rotating shaft, a number of door wings spaced around it and mounted thereto, a pair of opposite panels bordering the door wings and defining a partly closed zone with a first and a second opening, a drive motor for the shaft and a control unit for the drive motor, which revolving door is provided with a detection means for detecting a person authorized or unauthorized to access the room, and a first sensor for detecting an unauthorized person entering the zone through the first or the second opening respectively, the control unit turning off the drive motor in response to the first sensor.

Such revolving doors are known in different embodiments. The control unit for the drive motor of a known revolving door of this type is formed in such a way that the control unit will only stop the drive motor when the unauthorized person is captured between two door wings and an adjacent panel and subsequently will have the shaft rotated automatically in reverse direction, whereby a person attempting without authorization to proceed from the first to the second opening, will be forced to return to the first opening. Though in this way the known revolving door will provide an adequate protection of the access to the room, the known revolving door has the disadvantage that the reverse rotation caused by a person attempting to obtain access to the protected room highly decreases the throughput capacity of the revolving door, i.e. the number of persons that can pass the revolving door per unit of time.

The invention has the object to provide a revolving door of the above-mentioned type, ensuring on the one hand an efficient protection of the access to the room, while maintaining on the other hand a high throughput capacity.

SUMMARY OF THE INVENTION

In order to achieve this object the revolving door according to the invention is characterized in that there is provided a second sensor detecting the presence of an unauthorized person outside the zone in or close to the first or second opening respectively, the control unit turning off the drive motor in response to the second sensor.

In this way there is provided a revolving door permitting to detect any attempt to access the partly closed zone by means of the second sensor in an early stage, so that the driving of the shaft can be stopped more quickly. As a consequence the unauthorized person will generally before entering the partly closed zone note that he cannot pass the revolving door, and the free opening between the door wing moving in the direction of the adjacent panel and this panel will in all circumstances remain sufficiently sized to permit the unauthorized person to leave the partly closed zone, so that the shaft does not need to be rotated in the reverse direction. In this way the throughput capacity of the revolving door is considerably increased.

The invention is further described below with reference to the accompanying drawings showing schematically by way of example one embodiment of the revolving door according to the invention.

DETAILED DESCRIPTION OF A PREFERRED EMBODIMENT

Figure 1:
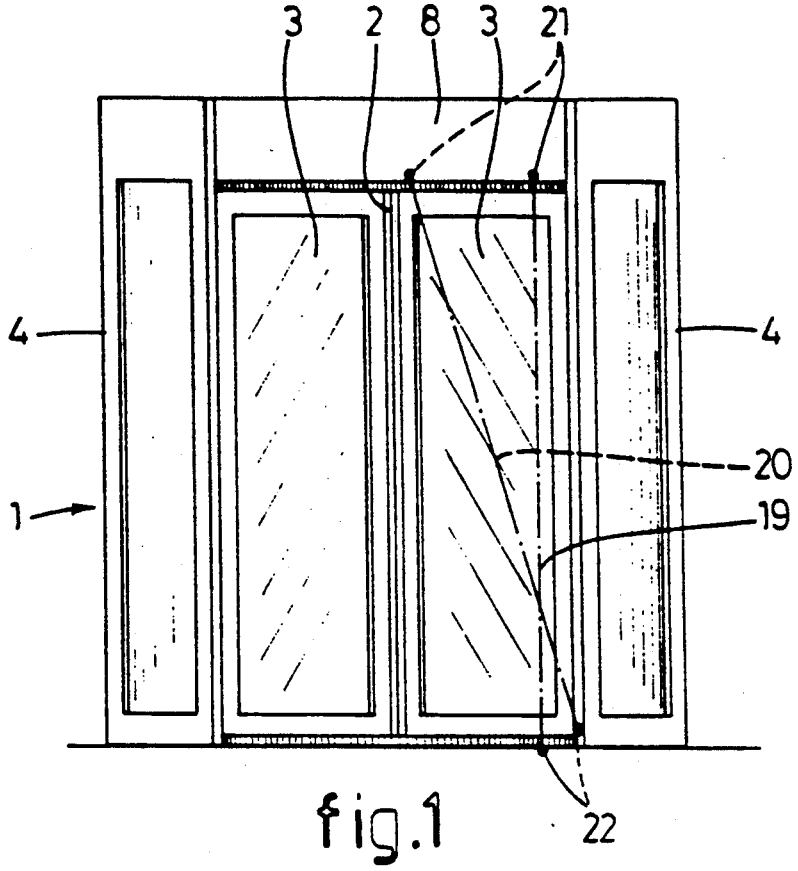
FIG. 1 is a front view of an embodiment of the revolving door according to the invention, in which different embodiments for the second sensor have been schematicly shown.
Figure 2:
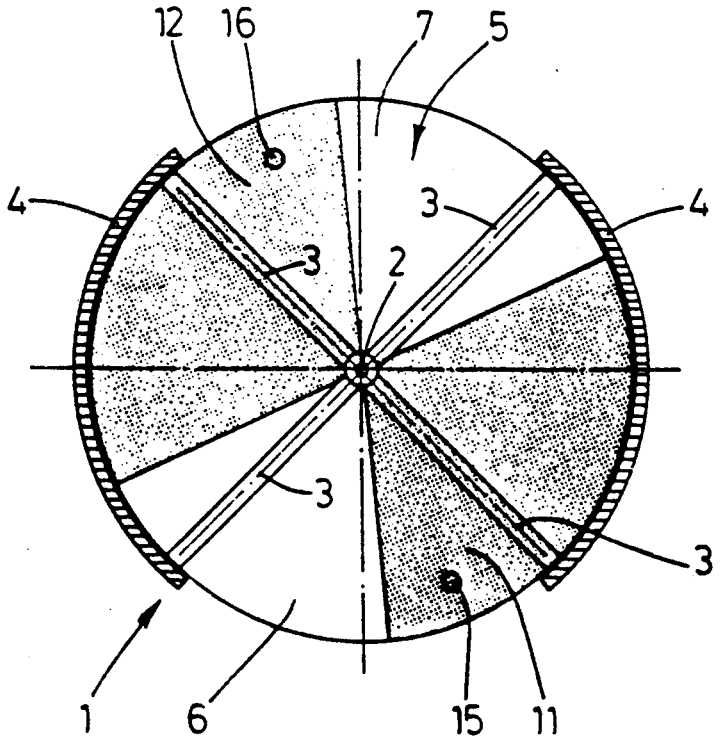
FIG. 2 is a schematicly shown horizontal cross-section of the door of FIG. 1.
Figure 3:
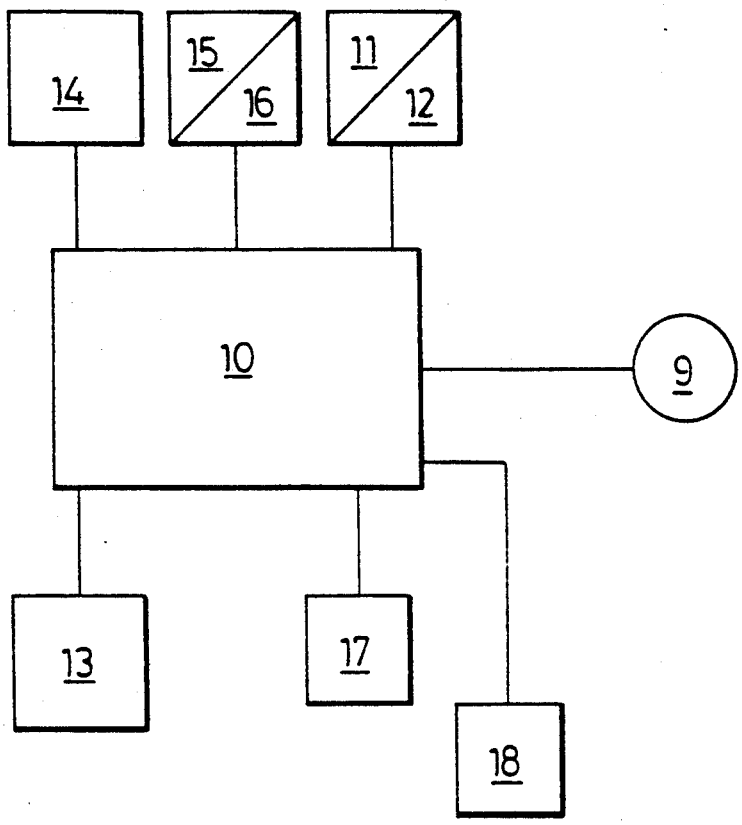
FIG. 3 is a strongly simplified block diagram showing the electrical circuit of the revolving door of FIG. 1.

With reference to FIG. 1 and 2 there is provided a revolving door 1 for protecting the access to a room, the revolving door 1 comprising a rotating shaft 2 and four door wings 3 mounted to the shaft 2 and spaced evenly around it. The revolving door 1 further comprises two opposite panels 4 bordering the door wings 3 and defining a partly closed and in this case circularly formed zone 5 having a first opening 6 and a second opening 7. In a space visibly covered by a screen 8 above the door wings 3 is in a usual manner accommodated a drive motor 9 for the shaft 2 and a control unit 10. The control unit 10 and the drive motor 9 are shown in the strongly simplified block diagram of FIG. 3.

Within the partly closed zone 5 defined by the panels 4 are provided two contact mats 11, 12 being formed in a usual manner and extending in the shown embodiment through a circular sector of approximately 110°, divided into a circular sector part of about 40° located on the one side of a door wing 3 and a circular sector part of about 70° located on the other side of said door wing 3 when the revolving door is not rotating. These contact mats 11, 12 will signal the zone 5 being accessed to the control unit 10. The revolving door 1 further comprises a card reader unit 13 shown only in the block diagram in FIG. 3 and installed for example at the first opening 6 serving in this case as entrance side for the room to be protected on the other side of the revolving door 1. Obviously it is also possible to install a card reader unit 13 at the second opening 7 when also the exit from the room has to be protected. By inserting an authorization card a person wishing to access the room can indicate that he is authorized to access this room. As soon as this person subsequently enters the zone 5 and steps on the contact mat 11, the drive motor 9 will be energized by the control unit 10 in order to rotate the shaft 2 through an angle of 180°, so that the authorized person can leave the zone 5 entering the protected room through the second opening 7.

The revolving door 1 described is provided with an indicator 14, which permits the control unit 10 to notify said person whether or not the authorization card has been accepted. When on both sides of the revolving door 1 a card reader unit 13 is installed, then also on both sides there is provided an indicator 14. In addition to the contact mats 11, 12 the revolving door I described further comprises detection means 15, 16 for signalling the access of the zone 5 to the control unit 10. The revolving door 1 further comprises as usual a number of switches 17 permitting the detection of the position of the door wings 3.

In order to provide effective protection of the access to the room, it is required to signal to the control unit 10 the access of the zone 5 by an unauthorized person attempting to enter the zone 5 with the intention to thus proceed to the protected room while the door wings 3 are rotating e.g. for passing an authorized person. For this purpose usually the contact mat 11 located on the side of the first opening 6 is used. Upon detection of an unauthorized person by means of the contact mat 11 and/or the detection means 15 the drive motor 9 will immediately be stopped in order to prevent the unauthorized person to reach the protected room. In practice it turned out that some persons by using some degree of dexterity managed to be captured in the space between two sequential door wings 3 and the adjacent panel 4, in which situation they had to be released either with aid of an available security guard or by automatic rotation of the door wings 3 in a reverse direction. Undoubtedly this means a considerable delay for the normal use of the revolving door, causing a decrease in throughput capacity.

Using the revolving door described an unauthorized person is prevented from being captured in the zone 5 by means of a sensor 18 installed outside the zone 5 close to the first opening 6 and signalling an unauthorized person before he can enter the zone 5. As a consequence an unauthorized person can never be captured in the zone 5 between two sequential door wings 3 and the adjacent panel 4. The control unit 10 can timely stop the drive motor 9 in all situations, so that the opening remaining between a door wing 3 and the adjacent panel 4 is always sufficiently sized for leaving the zone 5. As a result the revolving door 1 does require neither the availability of a security guard nor the rotation of the door wings 3 in reverse direction. The possible delay caused by an attempt to enter the zone 5 by an unauthorized person remains limited to a minimum, providing the revolving door 1 described a high throughput capacity.

As is indicated in FIG. 1 by means of the broken lines 19 and 20 respectively the sensor 18 can comprise a transmitter element mounted for instance to the screen 8 and a receiver element 22 mounted to the panel 4 or installed on the floor, thus creating a light barrier protecting the first opening 6. It is also possible to mount a transmitter and receiver element to the screen 8, in which case the receiver element receives the transmitted signal only upon reflection on a person.

In order to prevent unnecessary stopping of the driving of the door wings 3, the control unit 10 will only respond to a signal from the sensor 18 when a door wing 3 passing the first opening 6 is in the circular arc sector preferably about 22,5° ahead of the panel 4. The length of arc along the path of the door wings 3 of the revolving door described is in that case about 35 cm.

When on the side of the protected room at the second opening 7 a card reader unit 13 is installed, then obviously also on this side of the revolving door 1 a sensor 18 can be mounted.

Though in the embodiment described above a card reader unit 13 is used requiring the insertion of an authorization card in order to determine whether or not a person is authorized, it is also possible to apply another type of detector, for instance a detector operating with a transmitter/receiver aerial mounted on the panel 4.

Though the invention is illustrated above based on an embodiment of a revolving door having four door wings 3, it is noted that the invention is also applicable to a revolving door having three door wings. Further it is noted that instead of contact mats also another type of sensor for detection of the presence of a person can be applied.

The invention is therefore not restricted to the embodiment illustrated above, which can be varied in several ways without exceeding the scope of the invention.

I claim:

1. Revolving door, particularly for the protection of the access to a room, comprising a rotating shaft, a number of door wings spaced around it and mounted thereto, a pair of opposite panels bordering the door wings and defining a partly closed zone with a first and a second opening, a drive motor for the shaft and a control unit for the drive motor, which revolving door is provided with a detection means for detecting a person authorized or unauthorized to access the room, and a first sensor for detecting an unauthorized person entering the zone through the first or the second opening respectively, the control unit turning off the drive motor in response to the first sensor, wherein a second sensor is adapted to detect the presence of an unauthorized person outside said zone in or close to the first or second opening respectively, the control unit turning off the drive motor in response to said second sensor, and said second sensor being in operation only if one of the door wings is present in an area of the first or the second opening respectively, which area, seen in the direction of rotation of the door wings, precedes a panel and has along the path of the door wings a length of arc of at most 80 cm, preferably 40 cm.

* * * * *